US005333971A

United States Patent [19]

Lewis

[11] Patent Number: 5,333,971

[45] Date of Patent: Aug. 2, 1994

[54] INTERLOCKING BULKHEAD

[76] Inventor: John A. Lewis, 8014 Buffalo Speedway, Houston, Tex. 77025

[21] Appl. No.: 970,562

[22] Filed: Nov. 3, 1992

[51] Int. Cl.[5] ..... E02D 5/00; E02D 7/20

[52] U.S. Cl. ..... 405/281; 405/274; 405/278

[58] Field of Search ..... 405/278, 262, 281, 280, 405/279

[56] References Cited

U.S. PATENT DOCUMENTS

| | | | |
|---|---|---|---|
| 778,354 | 12/1904 | Dobry | 405/281 |
| 1,197,374 | 9/1916 | Hobbs | 405/281 |
| 1,775,850 | 9/1930 | Dougherty | 405/278 |
| 1,847,507 | 3/1932 | Wilhelmi | 405/278 |
| 2,001,473 | 5/1935 | Smith | 405/278 |
| 2,050,934 | 8/1936 | Ditchburn | 405/281 |
| 2,090,728 | 8/1937 | Heide | 405/278 |
| 2,128,428 | 8/1938 | Murray | 405/278 |
| 3,492,826 | 2/1970 | Horsiketter et al. | 405/281 |
| 3,822,557 | 7/1974 | Frederick | 405/278 X |
| 4,690,588 | 9/1987 | Berger | 405/278 X |
| 4,863,315 | 9/1989 | Wickberg | 405/278 |
| 5,145,287 | 9/1992 | Hooper et al. | 405/262 |

*Primary Examiner*—Dennis L. Taylor
*Attorney, Agent, or Firm*—Marcella D. Watkins

[57] ABSTRACT

A bulkhead member for assembling a bulkhead is disclosed, comprising a body having two opposed faces and first and second substantially parallel edges. The first edge includes an integral split socket and the second edge includes an integral connecting bead. At least one of the opposed faces includes a planar surface, and one of the socket and bead is mounted adjacent the planar surface. The connecting bead is angled with respect to the planar surface, and the gap in the split socket is correlatively angled, such that when the bead of the first bulkhead member is lockingly received in the socket of another like bulkhead member, the planar surfaces of the two bulkhead members may be substantially coplanar, and the connecting bead and socket of the two bulkhead members are offset from the common plane of the planar surfaces of the two bulkhead members.

10 Claims, 5 Drawing Sheets

INTERLOCKING BULKHEAD

TECHNICAL FIELD OF THE INVENTION

The present invention relates to interlocking bulkhead members that can be assembled to form a bulkhead of substantially any desired height, length, or configuration. Still more particularly, the primary bulkhead members of the present invention each include at least one substantially flat surface on at least one side, so that when assembled into a bulkhead, the flat surfaces on the respective sides of the individual members lie substantially in the same plane, thus forming an extended, interrupted planar surface against which additional structural members may easily be placed if desired.

BACKGROUND OF THE INVENTION

The use of a bulkhead or retaining wall to separate land from water is, in general, well known in the art. Typically, such a bulkhead is used to contain and retain the earth, sand, gravel, or other such material comprising the adjacent land, and protect it from erosion due to wave action, surface water runoff, or other adverse environmental effects. Bulkheads can also be used to build the land up above the surface of the water to allow greater land usage.

Often it is desired to place some massive or rigid supporting members or material against a bulkhead on the landward side. The supporting members may have a flat surface that can be placed against the bulkhead. For example, the supporting members may comprise wooden timbers, metal beams, concrete blocks, or plastic channel. A problem exists with some types of prior art bulkheads in that they do not present a correlatively shaped surface on the landward side against which the supporting members can be placed in order to distribute the load on the bulkhead uniformly between and among the bulkhead members. This poorly distributed loading, which creates non-uniform stresses in the bulkhead members, sometimes results in damage to some of the bulkhead members or distortion of the bulkhead from its intended configuration, or in extreme cases, in partial or total collapse of the bulkhead. Other types of prior art bulkheads may provide a relatively uniform surface for distributing the loads, e.g., a flat wall surface over substantially the entire bulkhead, but they typically do so at the cost of either weakening the bulkhead or using heavier materials than required, or of having to shore up the bulkhead with pilings, sunken rods or pipes, or the like.

Accordingly, it is an object of the present invention to provide a surface on at least one side of the bulkhead against which the supporting members may be placed, if desired, so that the contact between the supporting members, e.g., on a flat surface thereof, and the bulkhead members is substantially uniform over the bulkhead and the load on the bulkhead is substantially uniformly distributed between and among the bulkhead members. It is another object of the present invention to accomplish the foregoing without having to use excessively heavy materials, and without weakening the bulkhead or having to shore it up with extraneous means.

In addition, the side of the bulkhead facing the water should be substantially free of sharp corners, edges, supporting rods or pilings, connecting clamps, nuts or bolts, or other such protrusions, because they could be hazardous to passing boats or other water traffic, or to swimmers, water skiers, or other water sports aficionados in the area.

Hence, it is another object of the present invention to provide a bulkhead having a water side which is relatively safe to passing persons or property, while at the same time enjoying the benefits of uniform loading and stress distribution on the landward side, as mentioned previously.

Because bulkheads are often used along an entire property line, it is desirable to provide a bulkhead that can be constructed easily and effectively to extend along and span virtually an unlimited length of water-land interface. It is also desirable to provide a bulkhead that can be constructed easily across such a great distance without requiring complicated bulkhead member assembling, fastening, and supporting means.

SUMMARY OF THE INVENTION

The present invention comprises the unique design and construction of interlocking bulkhead members which can be assembled to form a bulkhead of substantially any desired height, length, or configuration. The bulkhead is assembled from a plurality of substantially identical interlocking primary bulkhead members, and may include one or more interlocking connecting members. The primary bulkhead members and connecting members of the present invention are preferably made of a plastic or fiberglass material and are preferably formed by a process known as pultrusion, thus enabling them to be made to virtually any desired height.

The interlocking primary bulkhead members of the present invention each include at least one substantially flat surface on at least one side, so that when assembled into a bulkhead, the flat surfaces on that side of the individual members lie substantially in the same plane, thus forming an extended, interrupted planar surface against which supporting members such as the wooden timbers, metal beams, plastic channel or concrete blocks mentioned previously may be placed, if desired. By placing flat surfaces of the supporting members against the extended, interrupted planar surface of the bulkhead, the load imparted by the supporting members is distributed substantially uniformly over the bulkhead, and is substantially uniformly distributed between and among the bulkhead members.

A bulkhead constructed as above will also be relatively safe to passing persons or property, because preferably, in addition to the flat surface referred to in the preceding paragraph, each primary bulkhead member has at least one substantially flat surface on its other side, so that these additional flat surfaces also lie substantially in the same plane when assembled. This forms a second extended, interrupted planar surface along the bulkhead's outer face, in addition to that referred to above along its inner face. While itself forming a relatively nonhazardous face, if desired, this second interrupted planar surface can also serve readily to support other paneling, sheathing, bumper materials, or the like should the owner wish to so enhance the structure or appearance of the bulkhead.

The primary bulkhead members of the present invention are substantially identical with one another, thereby keeping manufacturing and inventory costs to a minimum, and can easily be connected together to form a bulkhead of substantially straight, or of selected right-angled, configuration. In addition, the present invention provides connecting members, which are also substantially identical with one another, and which may be incorporated into the bulkhead assembly in order to increase the number of possible configurations for the bulkhead. Both the primary bulkhead members and the connecting members are of uniform cross-section along their lengths, so that both members may be easily manufactured, for example with the pultrusion process referred to above.

With the primary bulkhead members and connecting members of the present invention, a bulkhead of virtually any desired useful shape can be constructed.

A bulkhead constructed according to the present invention has no moving parts, is relatively inexpensive and simple to manufacture, and is relatively easy to install. It requires no additional hardware or connectors, and typically requires no additional shoring means. It does not have to be made of excessively heavy materials. Such a bulkhead will be effective, reliable, and durable. If any of the members becomes damaged, it may be relatively easily replaced with another like member.

These and other objects and advantages of the invention will become apparent to those skilled in the art from the following detailed description of the preferred embodiment of the invention when read in conjunction with reference to the following drawings, wherein:

DETAILED DESCRIPTION OF A PREFERRED EMBODIMENT OF THE INVENTION

Figure 1:
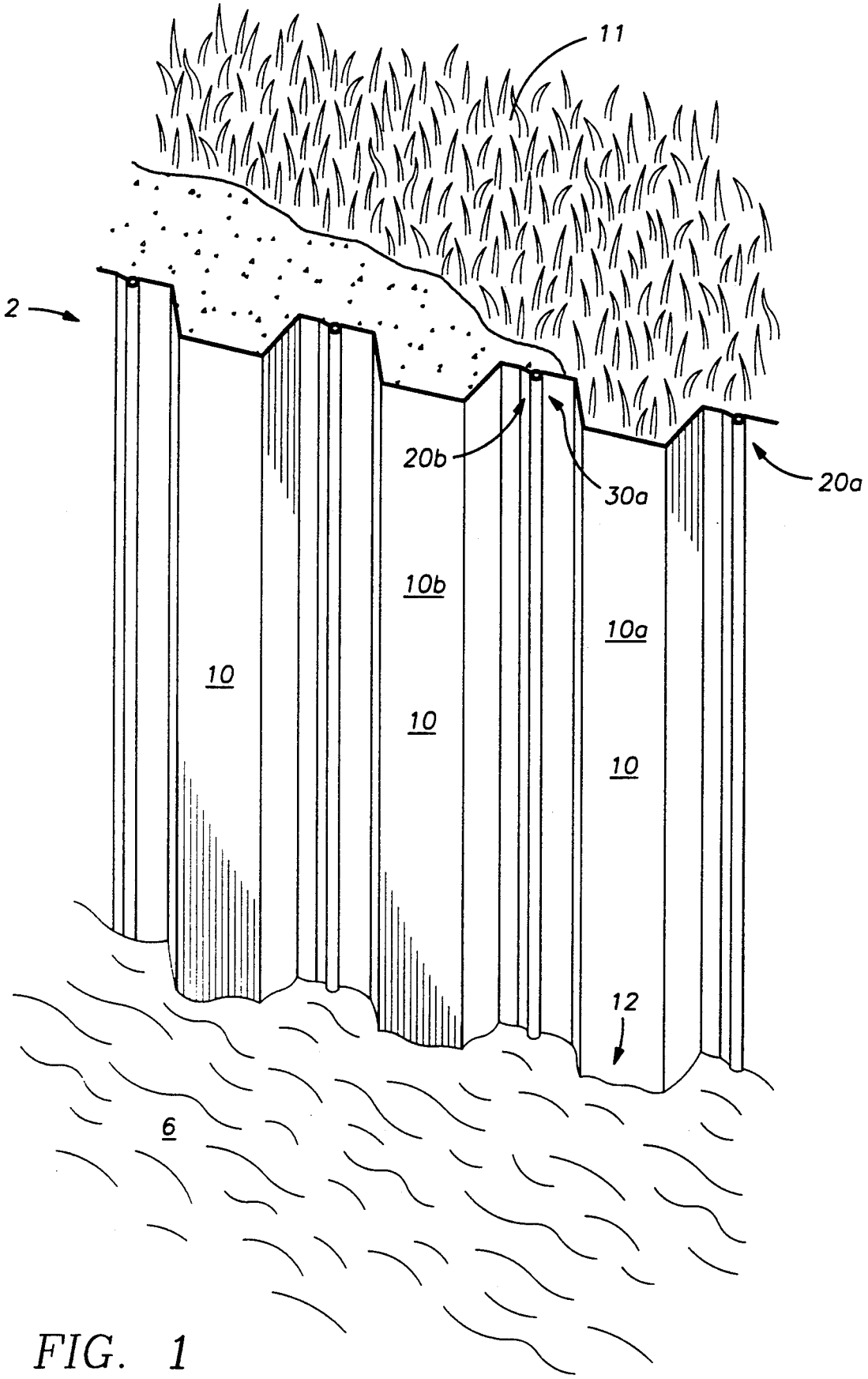
FIG. 1 is a pictorial view of a portion of a bulkhead constructed according to the principles of the present invention.

Referring initially to FIG. 1, there is shown a portion of a bulkhead 2 constructed in accordance with the principles of the present invention, comprising a plurality of interlocked primary bulkhead members or sections 10. Bulkhead 2 is illustrated as being used to retain an earthen mass 11 above and along a water line 12 of a body of water 6. Bulkhead 2 may be used, for example, to build up the ground level above the water's edge, or to prevent erosion or other loss of the soil from earthen mass 11 into water body 6.

Figure 2:
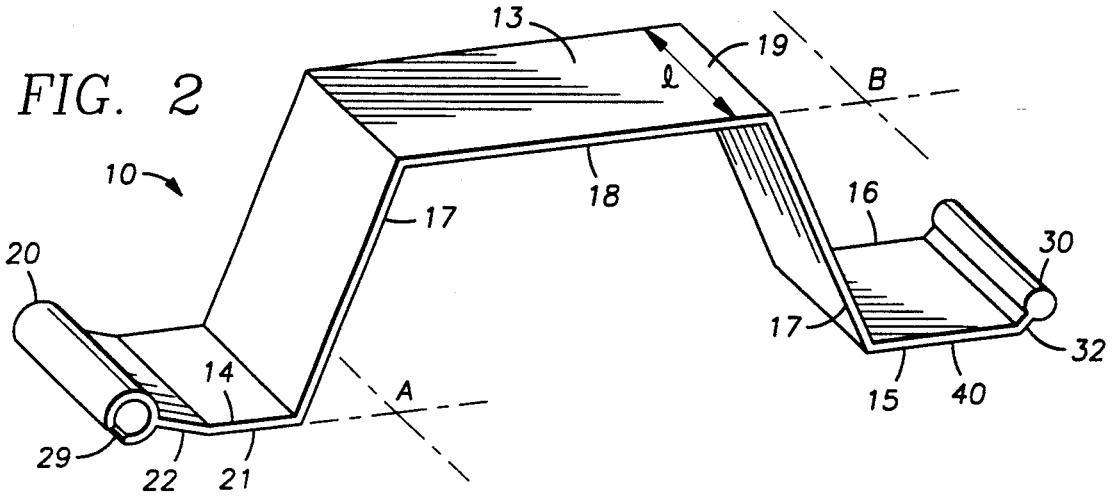
FIG. 2 is a three-dimensional, edge-on view of one of the primary bulkhead members of the present invention.
Figure 3:
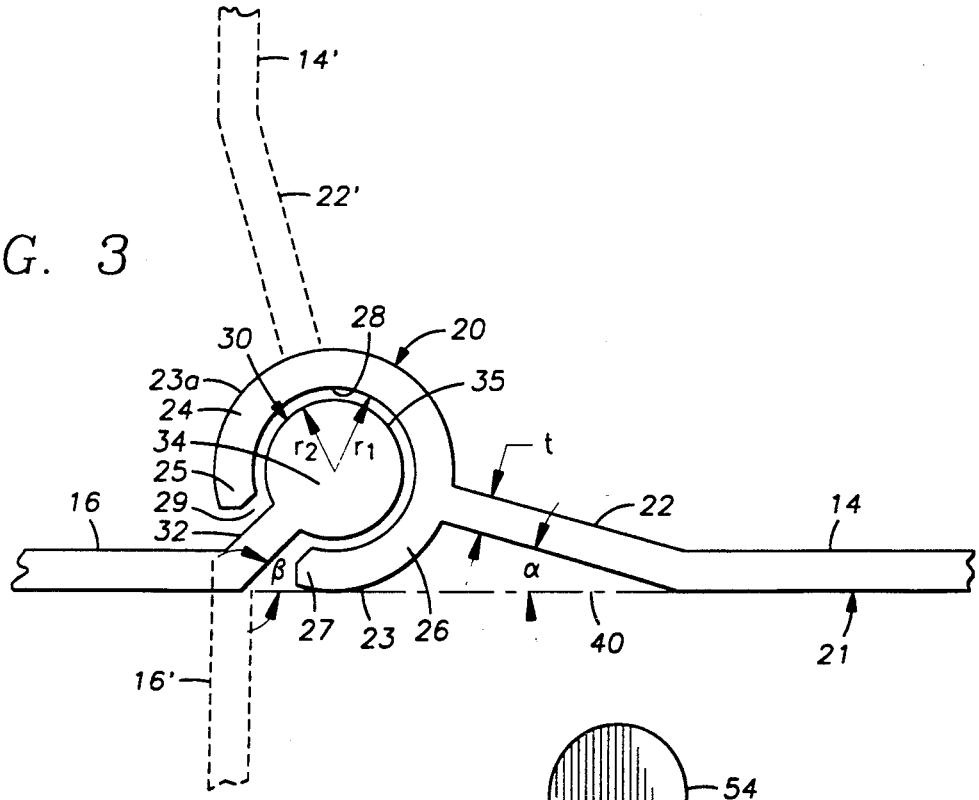
FIG. 3 is an enlarged, fragmentary edge-on view of the interlocking means forming a connection between adjacent primary bulkhead members of the present invention, illustrating the channel receptacle of one bulkhead member and the locking bead of the other bulkhead member.

Referring now to FIGS. 2 and 3, primary bulkhead member or section 10 comprises a body 13, having a channel receptacle or socket 20 along one edge and a locking or connecting bead 30 along the opposite edge. Body 13 comprises arms 14, 16, connecting members 17, and mid-section 18. Body 13 is preferably constructed so that outer surfaces 21 and 15 of arms 14 and 16, respectively, lie substantially in a first plane A, while outer surface 19 of mid-section 18 defines a second plane B. Socket 20 is joined to arm 14 by a neck 22, and connecting bead 30 is joined to arm 16 by a neck 32.

Socket 20 generally comprises an elongated split-tubular channel having a gap 29 along one side. In cross section, socket 20 has substantially circular outer surfaces 23, **23*a* extending between gap 29 and neck 22, a circular inner surface 28 having a radius of curvature of $r_1$, and a generally circular annular profile formed by circumferentially extending arm segments 24, 26. Arm segments 24, 26 terminate in spaced apart arm ends 25, 27, respectively, which form the opposed boundaries of the gap 29. Gap 29 is angularly disposed so that neck 32 of connecting bead 30 of the adjacent primary bulkhead member is received therein when two primary bulkhead members are interlocked as shown in FIG. 3**.

Connecting bead 30 generally comprises an elongated head 34 having a generally circular profile in transverse cross-section, and having a radius of $r_2$. Preferably, $r_2$ is incrementally less than $r_1$, so that there is a clearance $\Delta r$ between the outer surface 35 of head 34 and inner surface 28 of socket 20. According to the preferred embodiment, $\Delta r$ is relatively small, so that connected adjacent primary bulkhead members are prevented from shifting any great extent relative to each other. Clearance $\Delta r$ may even be small enough that there is some contact between outer surface 35 of head 34 and inner surface 28 of socket 20, so that there is some friction resisting relative motion of adjacent bulkhead members.

FIG. 3 illustrates an interlocking connection between socket 20 of one primary bulkhead member and connecting bead 30 of an adjacent primary bulkhead member. Neck 22 lies at an angle $\alpha$ with respect to arm 14. Similarly, neck 32 of connecting bead 30 lies at an angle $\beta$ with respect to arm 16. Preferably, angles $\alpha$ and $\beta$ are sufficiently large to allow connectors 20 and 30 of adjacent bulkhead members to be connected together without their respective faces 15, 21 breaking plane A. Preferably, angle $\alpha$ is about 15° and angle $\beta$ is about 45°.

Figure 4:
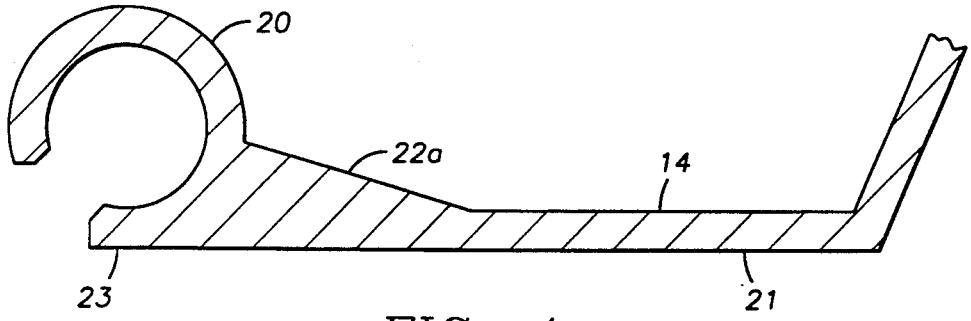
FIG. 4 is a view similar to FIG. 3, showing an alternative embodiment of the channel receptacle of the interlocking means of the primary bulkhead members of the present invention.
Figure 5:
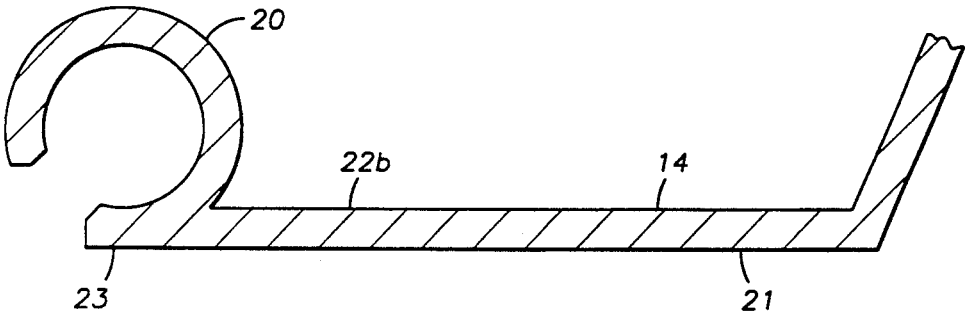
FIG. 5 is a view similar to FIGS. 3 and 4, showing another alternative embodiment of the channel receptacle of the interlocking means of the present invention.

Alternatively, as shown in FIGS. 4 and 5, socket 20 may be connected to arm 14 in other ways than shown in FIG. 3. For example, and not by way of limitation, FIG. 4 shows a socket 20 connected to arm 14 with a neck **22*a* of increasing thickness moving from the arm toward the socket, with the surface 21 being substantially continued to and through the lower part of the socket. As another example, FIG. 5 shows a socket 20 mounted onto essentially an extension of surface 21; i.e., the neck 22*b* and arm 14 are substantially coplanar, contiguous, and integral with one another. It will be apparent to persons skilled in the art that other configurations could be used for mounting socket 20 onto arm 14. In any event, it is preferred that the common axis of socket 20 and connecting bead 30, when they are connected together, be sufficiently offset from plane A to ensure that outer surface 23 of socket 20 of one primary bulkhead member will be flush with, or at least will not protrude beyond, surface 21 of arm 14 of that bulkhead member, or surface 15 of arm 16 of an adjacent primary bulkhead member. Thus, when the primary bulkhead members are assembled, the plurality of individual flat surfaces 21, 15** of the respective primary bulkhead members preferably form, in the aggregate, an extended, interrupted planar surface against which, for example, additional structural members such as wooden timbers, metal beams, concrete blocks, or the like may be placed if desired.

Referring again to FIG. 3, it should be understood that either of the adjacent primary bulkhead members may be inverted, by rotating its longitudinal axis 180°, and reassembled to the other primary bulkhead member so as to change the direction of the plane of the bulkhead, as shown by the phantom lines in that drawing. If connecting bead 30 is inverted, the position of neck 32 does not change, but arm 16 is displaced 90°, as shown at 16'. If socket 20 is inverted, both neck 22 and arm 14 are displaced 90°, as shown at 22' and 14'. It will also be appreciated that with identically shaped primary bulkhead members, although inverting one of two adjacent members permits creation of additional bulkhead configurations, there is a limit to the possibilities, because certain changes of direction are not possible. After a length of bulkhead has been constructed, a 90° turn in one direction will be permitted, while a 90° turn in the opposite direction will not be permitted.

In order to avoid this problem and also to allow for branched bulkhead configurations, according to the preferred embodiment of the invention, a connecting member 50 is provided in addition to the primary bulkhead member 10. Connecting member 50 is adapted to permit the bulkhead to be turned either right or left at any stage of construction, thus enabling the completed bulkhead to assume virtually any desired shape.

Figure 6:
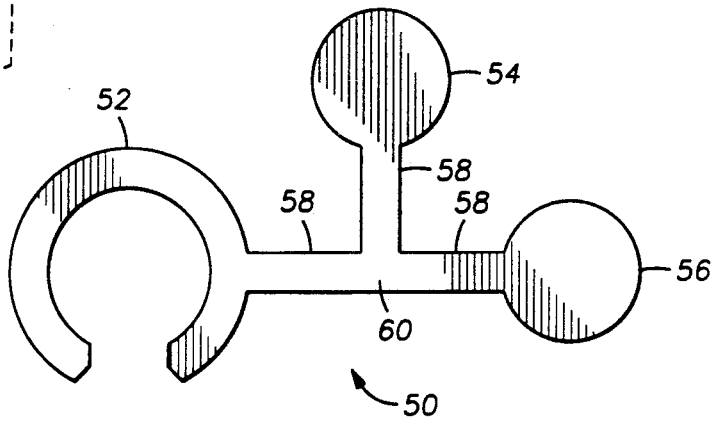
FIG. 6 is an edge-on or end-on view of an interlocking connecting member of the present invention.

Referring now to FIG. 6, connecting member 50 includes a single socket 52 and a pair of connecting beads 54, 56. Connectors 52, 54, 56 are each mounted on an arm 58, which arms 58 merge to form an integral body 60. As with the primary bulkhead members 10, the connecting members 50 can be inverted as necessary, and can also be rotated, to construct a desired bulkhead formation.

Referring again to FIG. 1, to construct a bulkhead according to the present invention, a first primary bulkhead member **10*a* is positioned relative to a second primary bulkhead member 10*b* so that one end of the connecting bead 30*a* of member 10*a* is aligned with and longitudinally spaced from one end of the socket 20*b* of second member 10*b*. The first and second members 10*a*, 10*b* can then be moved longitudinally toward one another so that connecting bead 30*a* of the first member is received in and substantially completely housed within socket 20*b* of member 10*b*, thereby substantially preventing relative lateral motion of members 10*a*, 10*b*. It will be further understood that a plurality of members 10** may be connected in this fashion, resulting in a generally straight bulkhead structure suitable for use, for example, as a retaining wall.

As long as the first primary bulkhead member is placed within a desired boundary line, its orientation is immaterial. That is, connection of succeeding bulkhead members may begin with this first member at either its socket edge or its connecting bead edge, and the connecting edges of each primary bulkhead member may be oriented to either side of the bulkhead, provided the bulkhead members are aligned so that they do not protrude beyond the boundary line. Although without the connecting member 50 a series of connected members 10 would be limited to linear runs and alternating left-hand or right-hand turns, with the addition of the connecting member 50, turns may be made in any direction, in increments of 90°, regardless of the orientation of the preceding member.

Figure 7:
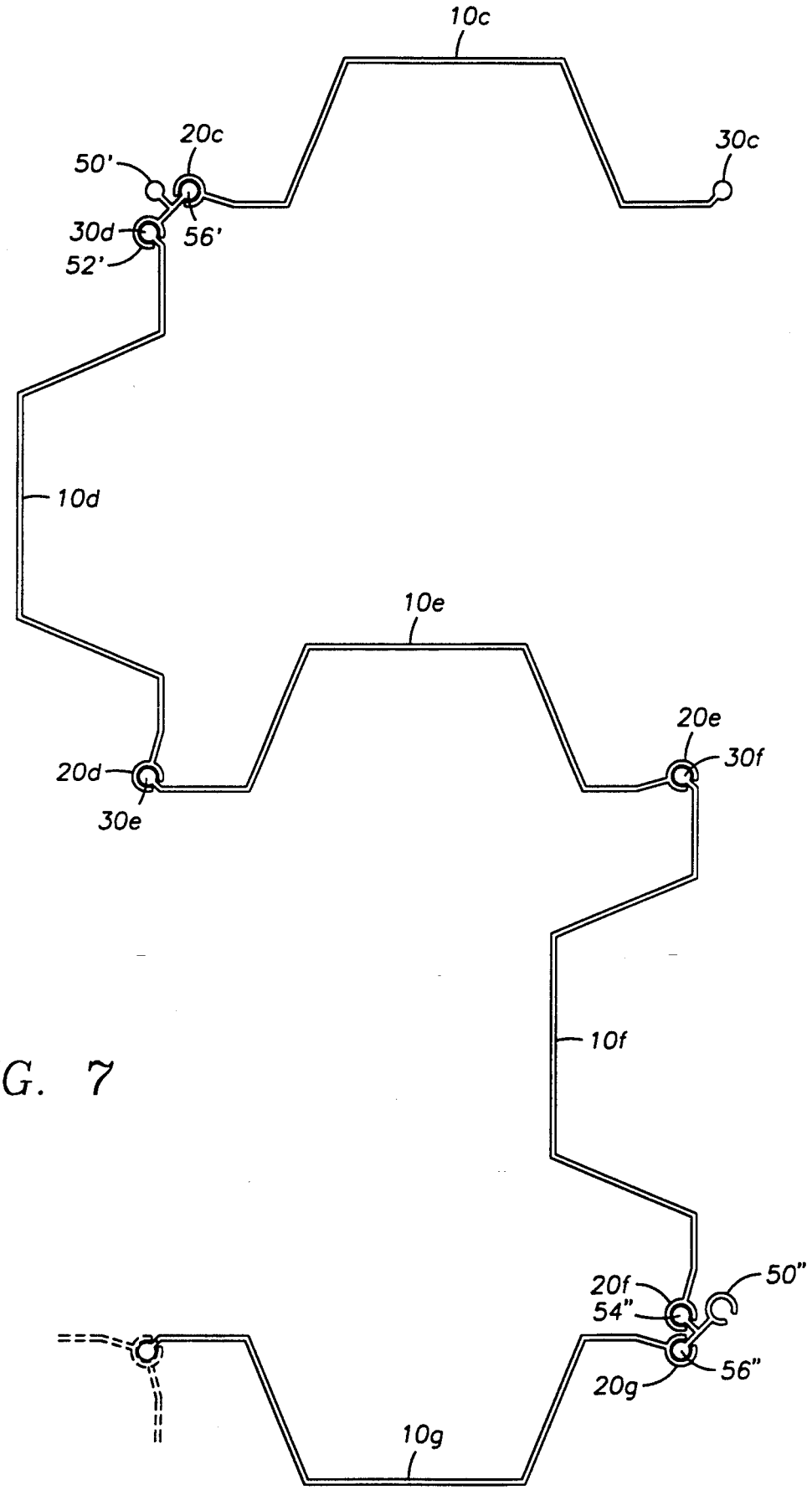
FIG. 7 is a schematic representation of a bulkhead configuration which may be obtained using five primary bulkhead members and a pair of connecting members of the present invention.

FIG. 7 illustrates how connecting member 50 can be used to this effect. As shown in FIG. 7, beginning from the upper portion of the drawing a primary bulkhead member **10*c* is disposed with its bead 30*c* toward the right and its receptacle 20*c* toward the left. A bead 56' of a first connecting member 50' is then connected to the receptacle 20*c*, and a bead 30*d* of another primary bulkhead member 10*d* is received in the receptacle 52' of connecting member 50'. This turns the bulkhead to the left. Then, bead 30*e* of bulkhead member 10*e* is inserted into receptacle 20*d* of member 10*d*, thereby turning the bulkhead to the left again, and bead 30*f* of member 10*f* is inserted into receptacle 20*e* of member 10*e*, thus turning the bulkhead to the right. Then bead 54" of connecting member 50" is inserted into receptacle 20*f*, and receptacle 20*g* of primary member 10*g* houses bead 56" of connecting member 50", thereby turning the bulkhead to the right again. It can be seen that with various combinations of members 10, 50, and with members 50 being inverted and/or rotated and members 10** inverted as desired, the bulkhead can be made to be straight or to turn right or left as desired, forming virtually any desired final configuration.

Typically, primary bulkhead members 10 and connecting members 50 of the present invention are driven one at a time into the ground along the line of the proposed bulkhead. Each successive member is aligned with and connected to the preceding member as it is driven into the ground, so that the interlocking connection is complete when the upper edges of the adjacent members are aligned or flush with one another. Alternatively, the tops of adjacent members may be staggered in predetermined fashion for its aesthetic effect. The interconnection of socket 20 and connecting bead 30 of each pair of adjacent members 10 provides a continuous coupling along the full height of the joint. The set-off between the plane of arms 14, 16 and the plane of midsection 18 creates a corrugated effect when several members are connected. This corrugated effect gives mechanical strength to the assembled bulkhead and reduces the chances of its buckling under a load.

Figure 8:
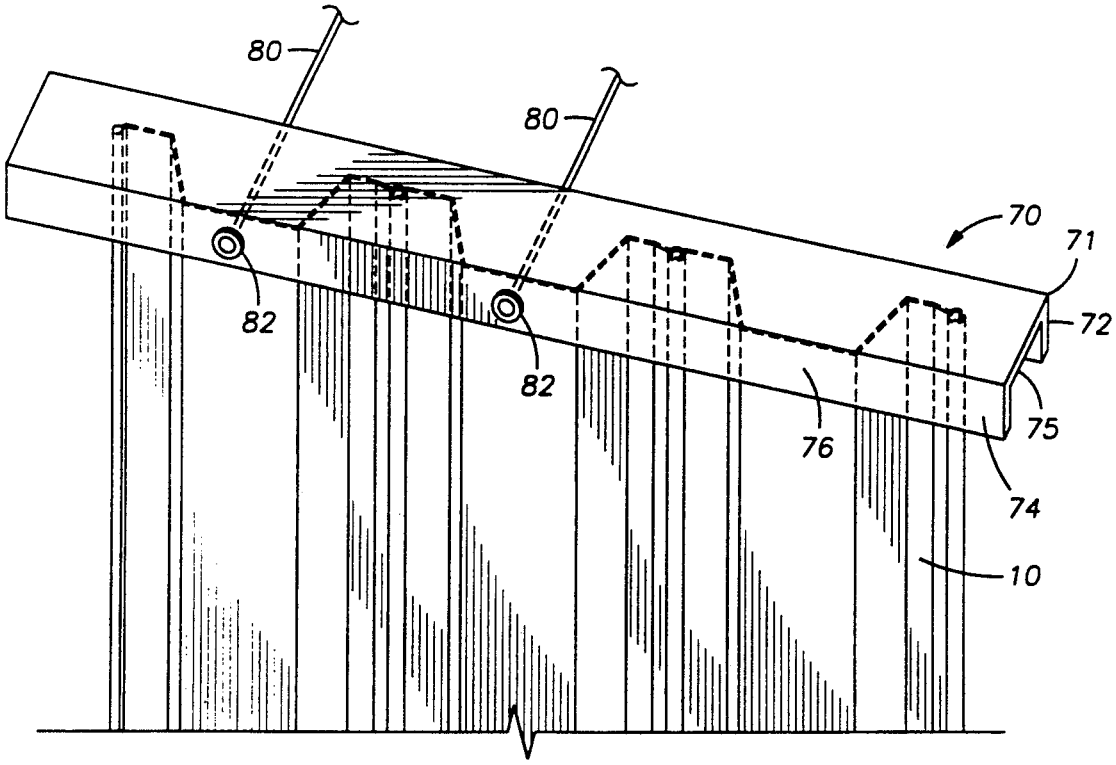
FIG. 8 is a pictorial view of a portion of a capped bulkhead, constructed according to the principles of the present invention.

Further according to the present invention, the assembled bulkhead may be topped with a cap 70, as shown in FIG. 8. Cap 70 comprises a channel 71 having legs 72, 74 extending downwardly on opposite sides of head member 75, and is preferably constructed of pultruded fiberglass. Preferably, the width of the channel corresponds approximately to the set-off or distance between the plane of arms 14, 16 and the plane of midsection 18, so that cap 70 fits snugly along the upper edge of the bulkhead. Cap 70 helps to keep the bulkhead members properly aligned and provides a more aesthetically pleasing upper edge for the bulkhead. Cap 70 can also serve as reinforcing material when it is necessary to apply a restraining force to the bulkhead. Such restraining forces might be necessary, for example, if the bulkhead is subjected to a large load, and can be applied by fastening anchors to the bulkhead at increments along its length by means of, for example, anchor lines 80, as shown in FIG. 8.

Figure 9:
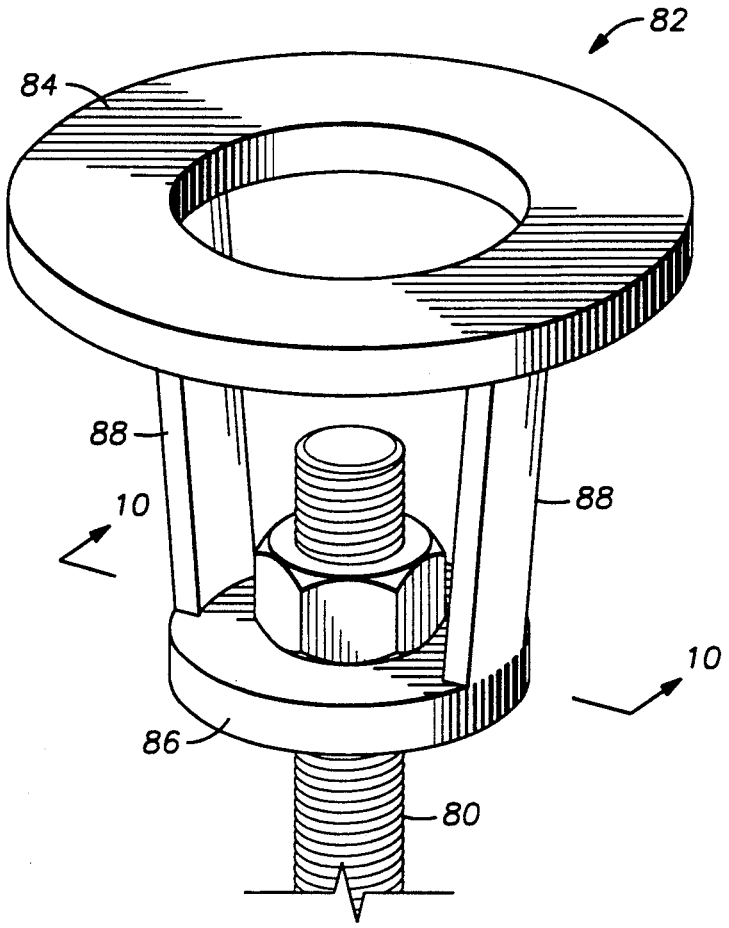
FIG. 9 is a pictorial view of a anchor line hanger for use with the present invention.
Figure 10:
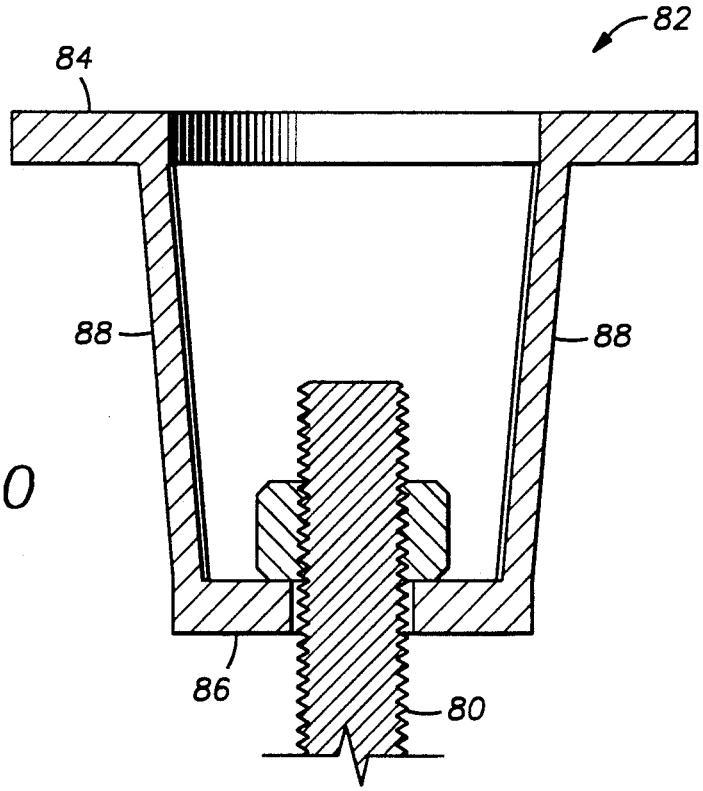
FIG. 10 is a cross-sectional view of the hanger of FIG. 9.

In instances where such anchor lines 80 are necessary, it may be preferable to use a special flanged hanger 82 on each anchor line 80, as shown FIGS. 8, 9 and 10. Hanger 82 is preferably formed of a rigid, inelastic material, such as metal or plastic. Hanger 82 includes a flange 84, a washer-like member 86, and a plurality of connecting members 88. In use, hanger 82 is set into a hole in the bulkhead, the hole having a diameter smaller than the outer diameter of flange 84, so that flange 84 rests on the outer surface of the bulkhead while connecting members 88 and washer member 86 extend inward through the bulkhead. An anchor line 80 may then be fastened to washer member 86, thereby forming a secure connection for anchor line 80 without the necessity of a bulky connection protruding from the outer bulkhead surface. For example, as shown in FIGS. 9 and 10, a nut 87 can be threaded onto the end of anchor line 80 and tightened until the desired tension in anchor line 80 is provided. The advantage of such a recessed connection is a relatively smooth, planar surface that will not damage boats or other vehicles that may come against it.

The primary bulkhead members and connecting members of the present invention are preferably made of fiberglass, and more preferably of pultruded fiberglass. Pultrusion is a known method of manufacturing wherein essentially laminar materials are coated with hardening compounds and pulled through a die to produce a rigid composite material having a uniform cross-section in one direction. This method permits the members 10, 50 to be made in virtually any desired length, so that a bulkhead can be constructed having virtually any preselected height, within the limits of the structural strength and integrity of the bulkhead so constructed. By way of example only, and not by way of limitation, the primary bulkhead members of the present invention are preferably about 12 to about 18 inches wide, that is, between bead 30 and receptacle 20. Again by way of example, a bulkhead constructed according to the teachings of the present invention may have a height, that is, a height above the ground, of from about two to three feet to about ten to twelve feet, but of course any reasonable desired height may be used.

While a preferred embodiment of the invention has been shown and described, modifications thereof can be made by one skilled in the art without departing from the spirit of the invention. For example, corners that are shown herein as sharp right angles may be rounded, and other angles and lengths may be varied without departing from the spirit of the invention.

I claim:

1. A bulkhead member for use in constructing a bulkhead, comprising:

a body whose thickness is small as compared to its height and width, and having a pair of oppositely disposed faces and first and second side edges;

one of said side edges including an integral split socket extending along a substantial portion of its height, said split socket having a longitudinally extending gap therein;

the other of said side edges including an integral connecting bead extending along a substantial portion of its height, said bead having an enlarged head portion connected to said body through a neck portion, said head portion being lockingly receivable within to split socket of another like bulkhead member with said neck portion being received within the gap of the latter split socket;

one of said faces including first and second coplanar flat surfaces, said surfaces forming the outer extremity of said face;

said connecting bead being disposed adjacent to said first surface and said split socket being disposed adjacent to said second surface;

said connecting bead being mounted on said body at a predetermined offset angle with respect to said first surface, and said gap of said split socket being disposed at an angle with respect to said second surface which is correlative to said predetermined angle, said connecting bead of said bulkhead member being connectable to the split socket of a like bulkhead member with said surfaces of adjacent members being substantially coplanar and with the connecting bead and socket of adjacent members being offset from the common plane of said flat surfaces of the two bulkhead members; and said predetermined offset angle and said angle of said gap of said socket further being such that when said bulkhead member is inverted, said bulkhead member is connectable to the split socket of a like bulkhead member with said surfaces of connected bulkhead members being substantially perpendicular to one another.

2. The bulkhead member of claim 1 wherein said connecting bead and said split socket are parallel to one another.

3. The bulkhead member of claim 1 wherein said body has a uniform cross-section along its height.

4. The bulkhead member of claim 1 wherein said body is made of fiberglass.

5. The bulkhead member of claim 4 wherein said body is formed by pultrusion.

6. The bulkhead member of claim 1, wherein said body further includes an integral mid-section between said side edges, said mid-section including a substantially planar portion forming the outer extremity of the other of said faces, said planar portion being transversely spaced apart from said flat surfaces of said one of said faces.

7. The bulkhead member of claim 6, wherein said outer extremities of said faces are substantially parallel to one another.

8. A connecting member for use in constructing a bulkhead, comprising:

an elongated body member having a pair of opposed parallel faces and a pair of opposed parallel edges, and an integral split socket extending along a substantial portion of one edge, said split socket having a longitudinally extending gap therein, said gap being disposed substantially transversely to one of said faces of said body member;

an integral first connecting bead extending along a substantial portion of the opposite edge of said body member, said first connecting bead having an enlarged head portion which is substantially centered between said faces of said body member; and an integral second connecting bead having an enlarged head portion mounted through a neck portion disposed on the other of said faces between said split socket and said first connecting bead, and extending transversely to said socket and said first connecting bead along a substantial portion of said body.

9. A connecting member according to claim 8 wherein said split socket and said connecting beads are sized such that said socket can receive either of the connecting beads of another like connecting member, and said connecting beads each can fit within the split socket of another like connecting member.

10. A bulkhead system for use in constructing a bulkhead, comprising:

a first member having a body whose thickness is small as compared to its height and width, and having a pair of oppositely disposed faces and first and second side edges;

said first side edge including an integral split socket extending along a substantial portion of its height, said split socket having a longitudinally extending gap therein;

said second side edge including an integral connecting bead extending along a substantial portion of its height, said bead having an enlarged head portion connected to said body through a neck portion, said head portion being lockingly receivable within a split socket of another like bulkhead member with said neck portion being received within the gap of the latter split socket;

one of said faces including first and second coplanar flat surfaces, said surfaces forming the outer extremity of said face;

said connecting bead being disposed adjacent to said first surface and said split socket being disposed adjacent to said second surface;

said connecting bead being mounted on said body at a predetermined offset angle with respect to said flat surface, and said gap of said split socket being disposed at an angle with respect to said second surface which is correlative to said predetermined angle, said connecting bead of said bulkhead member being connectable to the split socket of a like bulkhead member with said surfaces of adjacent members being substantially coplanar and with the connecting bead and socket of adjacent members being offset from the common plane of said flat surfaces of the two bulkhead members;

said predetermined offset angle and said angle of said gap of said socket further being such that when said bulkhead member is inverted, said bulkhead member is connectable to the split socket of a like bulkhead member with said surfaces of connected bulkhead members being substantially perpendicular to one another;

a connector member having first and second opposed parallel connector faces and first and second opposed parallel connector edges and an integral split socket extending along a substantial portion of said first connector edge, said split socket having a longitudinally extending gap therein, said gap being disposed substantially transversely to said first connector face;

an integral first connecting bead extending along a substantial portion of said second connector edge, said first connecting bead having an enlarged portion which is substantially centered between said connector faces; and an integral second connecting bead having an enlarged head portion mounted on a neck portion disposed on said second connector face between said split socket and said first connecting bead and extending perpendicularly to said second face along a substantial portion of said body.

* * * * *